United States Patent [19]

Jonas

[11] 4,125,984

[45] Nov. 21, 1978

[54] BUILDING PANEL CONSTRUCTION AND CONNECTOR THEREFOR

[76] Inventor: Gerald L. Jonas, 2217 Pacific Ave. #4, San Francisco, Calif. 94115

[21] Appl. No.: 776,721

[22] Filed: Mar. 11, 1977

[51] Int. Cl.[2] ..... E04B 2/28; E04C 2/34

[52] U.S. Cl. ..... 52/809; 52/285; 52/579; 52/584; 52/732; 52/813; 52/829

[58] Field of Search ..... 52/620, 624, 732, 615, 52/720, 586, 579, 584, 582, 580, 309.9, 285, 280, 738, 593, 592, 573

[56] References Cited

U.S. PATENT DOCUMENTS

| | | | |
|---|---|---|---|
| 2,678,116 | 5/1954 | Gruber | 52/615 X |
| 3,058,551 | 10/1962 | Martin | 52/573 |
| 3,074,123 | 1/1963 | Gartrell | 52/586 |
| 3,261,493 | 7/1966 | Smith | 52/285 X |
| 3,310,917 | 3/1967 | Simon | 52/586 X |
| 3,310,926 | 3/1967 | Bromdreth et al. | 52/582 |
| 3,367,076 | 2/1968 | O'Brien | 52/620 X |
| 3,382,639 | 5/1968 | Smith et al. | 52/586 |
| 3,432,196 | 3/1969 | Marchiorello | 52/584 |
| 3,439,465 | 4/1969 | Du Pre | 52/584 |
| 3,546,841 | 12/1970 | Smith et al. | 52/624 |
| 3,738,690 | 6/1973 | White | 52/732 X |
| 3,818,661 | 6/1974 | Pragg | 52/285 X |
| 3,835,611 | 9/1974 | Villeger | 52/624 |
| 3,841,043 | 10/1974 | Zinn | 52/481 X |
| 3,854,261 | 12/1974 | Frei | 52/584 |
| 3,992,840 | 11/1976 | Badat et al. | 52/285 |

FOREIGN PATENT DOCUMENTS

| | | | |
|---|---|---|---|
| 674,289 | 4/1966 | Belgium | 52/586 |
| 2,243,021 | 3/1973 | Fed. Rep. of Germany | 52/732 |
| 858,417 | 11/1940 | France | 52/620 |

*Primary Examiner*—Leslie Braun
*Attorney, Agent, or Firm*—Phillips, Moore, Weissenberger, Lempio & Majestic

[57] ABSTRACT

Laminated building panels are constructed within metal framing members having external edges to protect the panel skins from crushing. These frame members are essentially Z-shaped in cross-section in order to provide a degree of flexure during panel manufacture and use. The flexure accommodates variations in the dimensions of core and skin materials and enables the manufacture of fully laminated panels without excessive lamination pressure or the use of mechanical fasteners. Delamination stresses during use are also accommodated by the "Z" framing members. Panel to panel connections are facilitated in all configurations by the use of connectors of an essentially open triangular cross-section dimensioned to mate with, promote alignment, and wedge into, the "Z" shaped frame member.

8 Claims, 13 Drawing Figures

BUILDING PANEL CONSTRUCTION AND CONNECTOR THEREFOR

BACKGROUND OF THE DISCLOSURE

For a number of years, the press of population and the greatly increasing cost of labor and materials has created a demand for housing structures that may be erected with a minimum use of skilled labor using premanufactured structural members of a housing "package" that may be readily transported to the building site. However, although the demand exists, the success of "prefabricated" housing has not met with anticipated expectations due to a myriad number of problems. One of these problems exists in the design and manufacture, as well as structural attachment, of large structural panels which are most often used in such "prefabricated" structures. These panels, which often comprise the walls, flooring, and roof of such "prefabricated" structures may, because of economics and design consideration, be fabricated in relatively large dimensions in the order of, perhaps, 8 to 9 feet in height or width, and 20 to perhaps 40 feet or even longer in length. In the larger sizes, such panels, depending upon the material used in their construction, may weigh in the order of 800 to 1000 pounds.

In the last decade or so, with the availability of rigid synthetic polymeric foams, it has become advantageous to construct panel members utilizing rigid foamed materials as core members laminated between outer "skins" that may comprise plywoods, metal sheets, sheet rock, pressed board, and the like. The skins are laminated to the foamed core most generally by applying adhesive therebetween and forcing the same together in a tight bond with large presses.

Because the panels are relatively thin in relation to their overall horizontal dimensions, it is difficult to prevent warping or twisting of the panels either during manufacture or afterwards in use. It is therefore common to provide some type of a frame for the panel structures. These frames may comprise only peripheral members, but, frequently, with additional internal studs or stiffeners interconnecting the external frame members. Most often, the frame members, both peripheral and internal, are constructed from either metal or wood sections.

Where common wood framing is used, the frames are subject to excessive warping. In addition, such wood framing usually requires careful handling and extensive labor during erection in order to provide tight joints and proper alignment of the panels.

Panels utilizing metal frames most often employ rectangular channels and mating shoes for effecting joints between panels. Such rectangular shaped channels and shoes are, however, susceptable for handling damage and require careful alignment for proper seating.

Other prior panel structures utilize spline and extrusions for joint structures. Such systems, however, generally require complicated spline shapes; they are usually expensive to manufacture and are poor structurally. Their use is usually limited to readily accessible situations.

All such prior panel edge structures tend to be very rigid and non-resilient. Thus, any variations in core dimensions tend to produce weakened lamination areas that are subject to delamination during stress in use.

BRIEF DESCRIPTION OF THE INVENTION

The present invention relates to large building panels of a laminated construction wherein a foamed core material is faced with skins of plywood, sheet metal, sheet rock, pressed board, or the like. More specifically, the invention relates to frame members that form the periphery of said panels and means for connecting said panels together into a structure.

The frame members comprise elongate metal extrusions that have a generally "Z" shaped cross-section, wherein one open portion of the "Z" faces into the interior of the building panel. Outwardly extending flanges or lips are provided on the extrusion to bear against, and positively position the panel "skins"; and, further, to form a protective edge around the entire panel.

The metal frame members are sufficiently rigid and strong to minimize, or eliminate the necessity for jigging during assembly or lamination of the panel. In addition, the "Z" section is sufficiently flexible to compensate for variations between core thickness and frame width during the lamination process. The frame extrusion is made with a small oversize face to face dimension which is equal to the maximum expected accumulated variation of the panel components thickness. Under lamination pressures the "Z" frame will flex or deflect to an extent necessary to effect a close bonding of all panel components, regardless of irregularities in the various components. Thus excellent lamination bonds are achieved.

The panels of the invention are attached utilizing a connector that mates with the "Z" section frame members. The connector comprises an elongate metal extrusion having an open, generally triangular, cross-section that is dimensioned to fit tightly by wedging action into an open end of the "Z" frame as will be hereinafter described. The connector is shaped such that a snug connection is achieved in a number of alternate orientations.

The frame and connector system is self-aligning and self-guiding and achieves a stiff, weather tight connection which is resistant to damage and provides positive positioning of adjacent panels. The joint further resists panel movement in all directions across the joint.

It is therefore an object of the invention to provide frame members for laminated building panels.

It is another object of the invention to provide connectors for joining building panels.

Another object of the invention is to provide frame members for building panels that protect the panel edges from crushing.

Another object of the invention is to provide frame members for building panels that flex under pressure to adjust for irregular dimensions in core members.

It is yet another object of the invention to provide for the mating of large building panels with self-aligning, self-guiding, and vermin proof joints.

It is still another object of the invention to provide "Z" shaped frame members for building panels.

It is still another object of the invention to provide building panel connectors that mate with "Z" shaped frame members.

Other objects and advantages of the invention will become apparent from a review of the following description, the appended claims, and the drawing.

DETAILED DESCRIPTION OF THE DISCLOSURE

Figure 2:
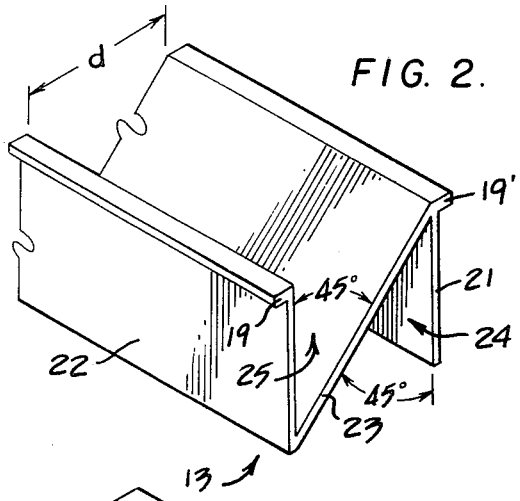
FIG. 2 is a perspective view of a section of a "Z" shaped extrusion that comprises the frame members of the invention.
Figure 3:
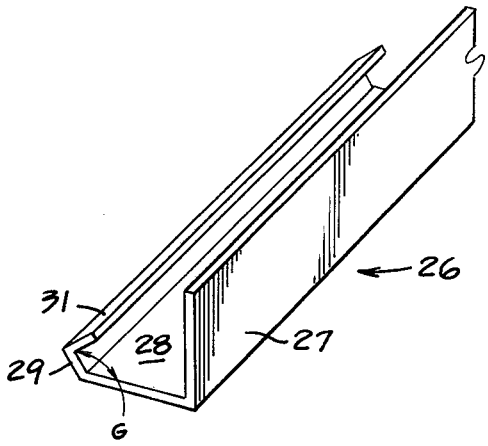
FIG. 3 is a perspective view of a section of the connector extrusion of the invention.
Figure 1:
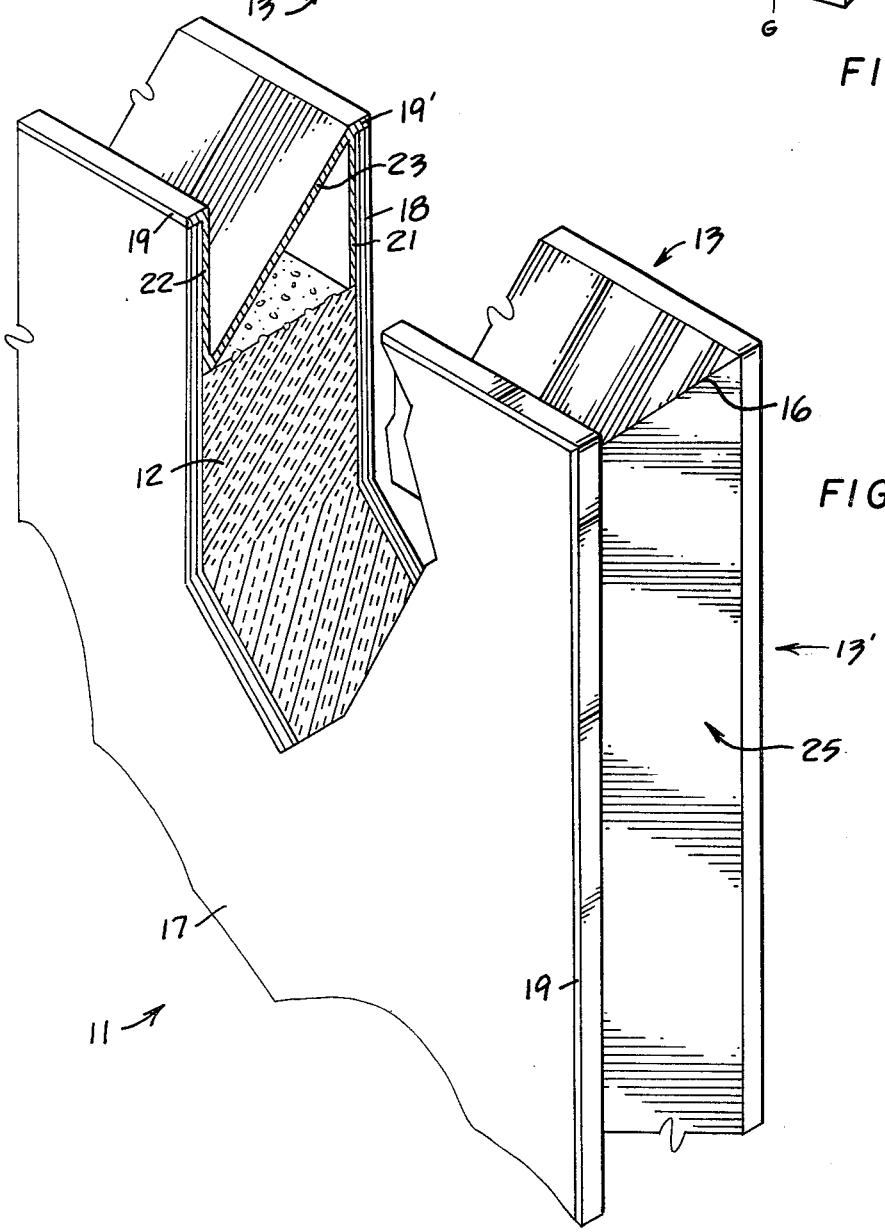
FIG. 1 is a cut-away perspective view of a portion of a building panel.

With particular reference to FIGS. 1, 2 and 3, it will be noted that a building panel 11 comprises a core 12 that is somewhat smaller in length and height than panel 11. Surrounding core 12 are frame members 13 and 13' which meet at mitered joint 16. It will be understood that additional frame members (not shown) surround the entire periphery of core 12 to form a solid frame thereabout.

The front and back surfaces of core 12 are completely covered by skins 17 and 18. Skins 17 and 18 also extend to cover at least a portion of the frame members 13 and 13' and abut flanges or lips 19, 19' that form integral exterior portions of the frame members. Skins 17 and 18 are laminated to core 12 and frame members 13 and 13' (and the other similar frame members, not shown) to form a rectangular building panel. Such panel may extend many feet on a side, typically 8 feet in height and 20–40 feet in length. Only one corner of the entire panel 11 is shown in FIG. 1; however, the remainder of the panel is identical in construction with the portion shown.

A glue or adhesive is coated over the entire interior surfaces of skins 17, 18 before they are placed into contact with core 12 and frames 13, 13', etc. The entire assembly is then held in a press to force the skins 17, 18 into intimate contact with core 12 and frame members 13, 13', etc. Pressure is maintained for a sufficient period of time to permit the glue or adhesive to set or polymerize to form a strong bond between the core 12 and skins 17, 18; and between frame members 13, 13', etc., and skins 17, 18.

Considering frame members 13, 13' in greater detail, and with reference to FIG. 2 especially, frame member 13 is an elongated extrusion, preferably fabricated from aluminum or other light-weight strong and resilient alloys. Frame member 13 is essentially "Z" shaped in cross-section comprising a first leg 21 and a second leg 22 joined by a web 23. Web 23 meets both legs 21, 22 most usually at angles of 45°, whereby legs 21 and 22 are parallel to one another.

Outwardly extending flanges or lips 19, 19' of similar dimensions protrude in opposite directions from legs 21, 22. However, one of said flanges 19 extends from second leg 22 at its end most distant from the junction with web 23; while the second flange 19' extends outwardly from first leg 21 adjacent its juncture with web 23. Both flanges 19, 19' are of a length essentially the same as the thickness of skins 17, 18. Thus, when skins 17, 18 are laminated to core 12, their peripheral portions extend over the outer surfaces of legs 21, 22 into abutting relationship with flanges 19, 19' respectively. It will be noted that flanges 19, 19' thereby form protective edges for skins 17, 18 and for panel 11 as a whole.

It will be also apparent that when fabricated into the panel 11, the inner surface of first leg 21 and web 23, along with the exterior edge of core 12 will form a hollow interior chamber 24, having a triangular cross-section around the entire periphery of panel 11. At the same time, an external wedge shaped groove 25 defined by the interior surface of second leg 22 and web 23, is formed around the entire exterior edge of panel 11. Frame member 13, being fabricated from metal and comprising the entire peripheral edge of panel 11 serve to protect the panel during handling and fabrication into structures. The metal edges protect the panel skins (plywood, sheet metal, sheet rock, etc.) against crushing, splintering and other damage during handling. In addition, the metal edges provide a neat, finished appearance to the panels.

Of course, a building structure may require a number of panels 11 as its walls, ceilings, roofs, and/or floor portions. It is therefore necessary to join such panels together. The joints between panels must be weather and vermin proof and, in addition, it is desirable that the panels may be erected with the least amount of labor and difficulty as possible. These considerations make it advantageous to provide joint structures and connector means that make the joints self-aligning and self-guiding.

Such self-aligning and self-guiding, secure, weather and vermin proof joints are provided for in the panels of the present invention by connector means that co-act with the "Z" frames of the panels.

With particular reference to FIG. 3, it will be noted that the connector means comprises an elongate extruded metal strip 26 with a cross-section of a generally open triangular configuration. The connector includes a first leg 27 that is somewhat shorter than the distance "*d*" between leg 22 and the junction of web 23 and leg 21 of frame member 13. A second leg 28 is integral with first leg 27 and is disposed at right angles thereto. Second leg 28 is dimensioned somewhat shorter, perhaps 60–75% of the internal length of leg 22 of frame member 13. A third leg 29 is integral with second leg 28 and extends therefrom at an angle "G" of 135°. Third leg 29 terminates at a junction with a fourth leg 31 that extends in a direction towards first leg 27 but it, in turn, terminates a considerable distance therefrom. Fourth leg 31 forms a 90° angle with third leg 29.

It should be understood that the angles given between the legs and web of frame member 13 and the legs of connector 26 are for preferred embodiments. If desired, legs 21, 22 of frame member 13 may be considerably lengthened or shortened, in which event the internal angles formed at the junctions of web 23 therewith will vary above or below 45°, as the case may be. In the event the angular configuration of frame members 13 is varied, then the angular relationships of legs 28, 29 and 31 of connectors 26 must be varied so as to effect a tight wedging fit (see FIGS. 4–6) into channel 25. In any event, however, the angle between first leg 27 and second leg 28 will always be 90°.

Figure 4:
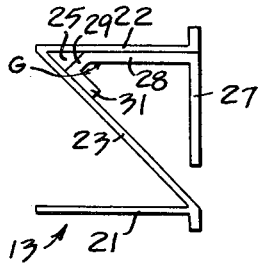
FIGS. 4, 5, 6 and 7 are cross-sectional views indicating various configurations wherein the connector mates with the frame member.
Figure 5:
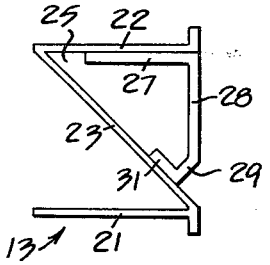
Figure 6:
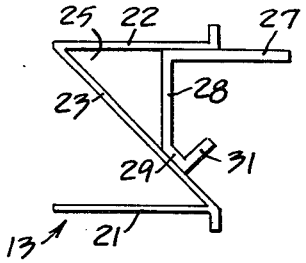

FIGS. 4–6 indicate the various ways in which channel 26 may effect a tight wedging joint with channel 25 of frame 13. As noted in FIG. 4, second leg 28 may be wedged against leg 22 of frame 13, while fourth leg 31 is wedged against web 23. In such position, first leg 27 is essentially flush with the end of leg 22 and the junction between web 23 and leg 21. in FIG. 5, first leg 27 is wedged against leg 22, while fourth leg 31 is wedged against web 23. In such configuration, second leg 28 is flush with the outer end of channel 25. In FIG. 6, a portion of first leg 27 is wedged against leg 22, while third leg 29 is wedged against web 23. In such configuration, a portion of first leg 27 extends in parallel alignment beyond the end of frame leg 22.

Figure 7:
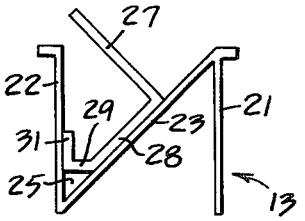

FIG. 7 illustrates a mating ocnfiguration between frame member 13 and connector 26 in which one leg (first leg 27) of the connector extends at an angle with frame 13. Such connection is useful in providing a joint between roof panels and a wall panel where it is necessary for the roof panel to form other than a 90° angle with the wall panel.

Figure 13:
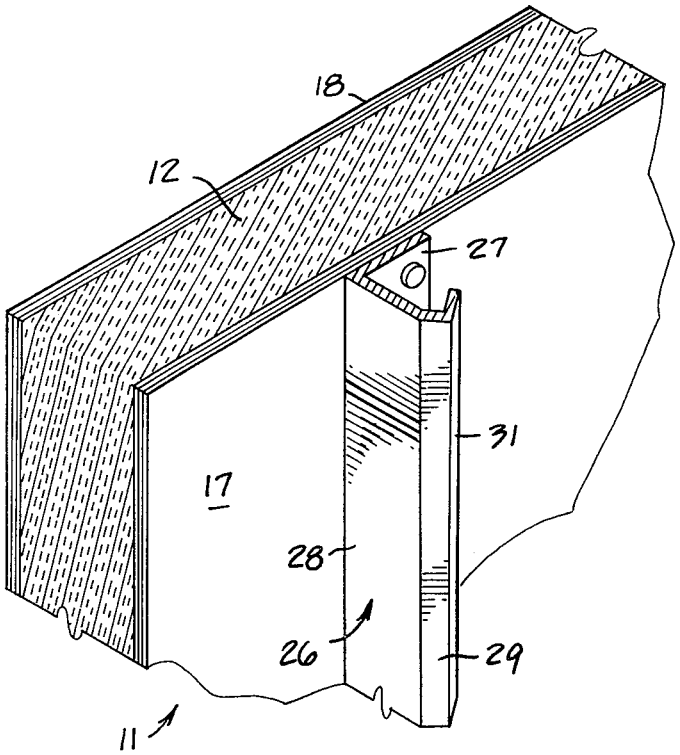
FIG. 13 is a partial perspective view of a connector affixed to a mid-portion of a panel.
Figure 12:
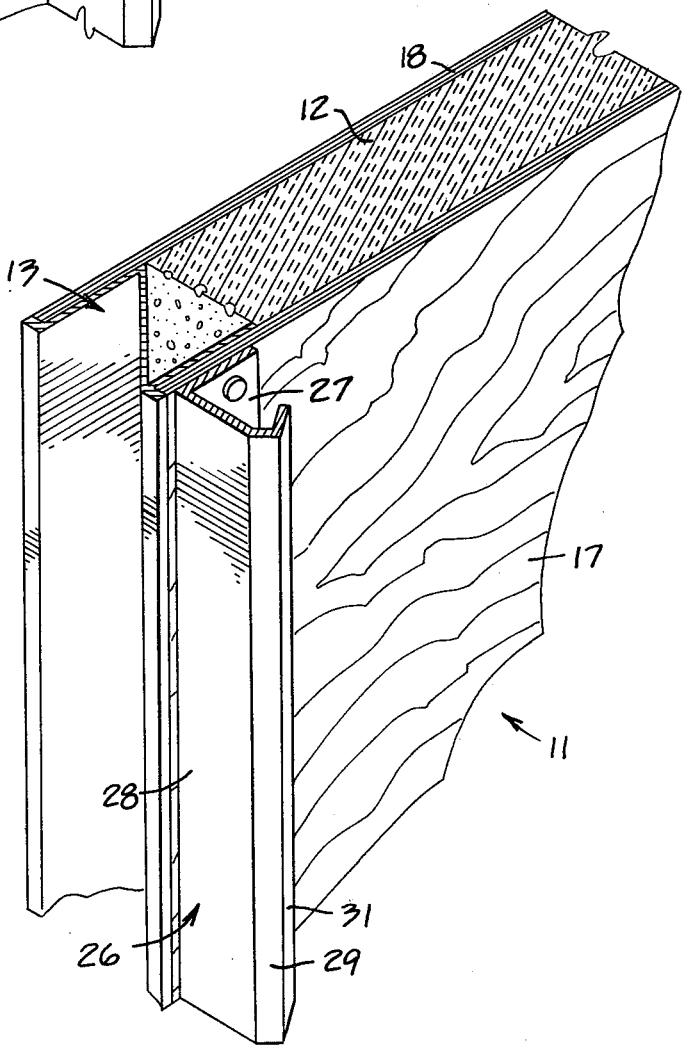
FIG. 12 is a partial perspective view of a connector affixed to the edge of a panel.

As illustrated in FIGS. 12 and 13, connector 26 may be attached to various portions of a panel 13 in preparation for joining panels together. In the event panels are to be joined at their ends and at right angles, connector 26 is affixed slightly inwardly of one edge thereof as by means of screws, bolts, or the like. As will be noted in FIG. 12, the connector overlies one end of skin 17. Metal frame member 13, being disposed directly beneath skin 17, furnishes a secure and rigid anchor for the screws holding connector 26 to the panel.

Connector 26 may also be affixed to panel 11 at any intermediate position such as illustrated in FIG. 13. Such positioning may be utilized where one panel is to be joined to another at some midpoint of a wall in a structure; as, for instance, where interior rooms are to be erected.

Figure 8:
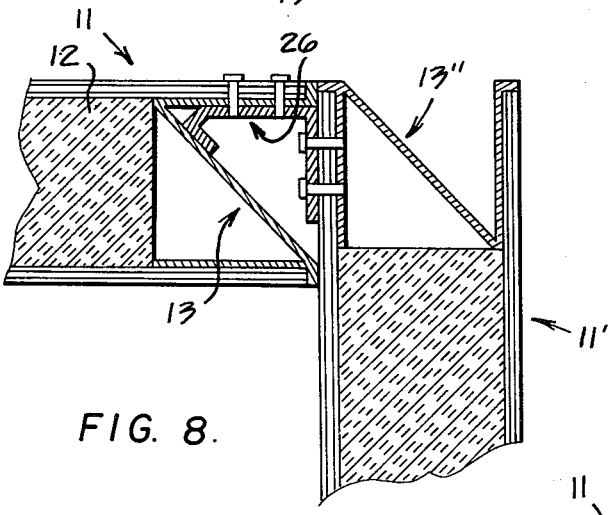
FIGS. 8, 9, 10, and 11 are cross-sectional views indicating various joints between building panels utilizing the frame and connector structures of the invention.
Figure 9:
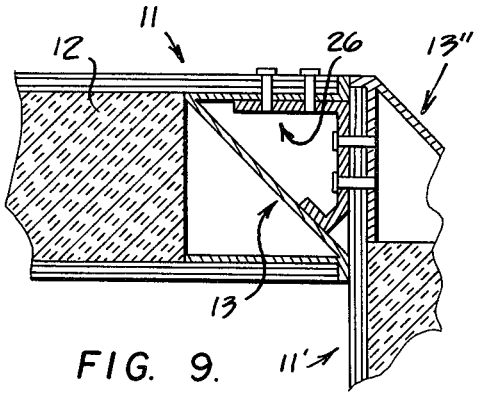

In any event, connector 26 is affixed to a panel 13 wherever a connection to an adjacent panel is desired. The connector 26 is cut to a length sufficient to completely mate with channel 25 of the adjacent panel. As will be obvious from FIGS. 4–6, 8 and 9, connector 26 may be affixed to it panel in several configurations, i.e., by first leg 27 or by second leg 28, where right angled connections are desired. FIGS. 8 and 9 illustrate right angled connections between adjacent panels 11, 11′ wherein frame 13 and 13′ are held by a single channel 26.

Figure 10:
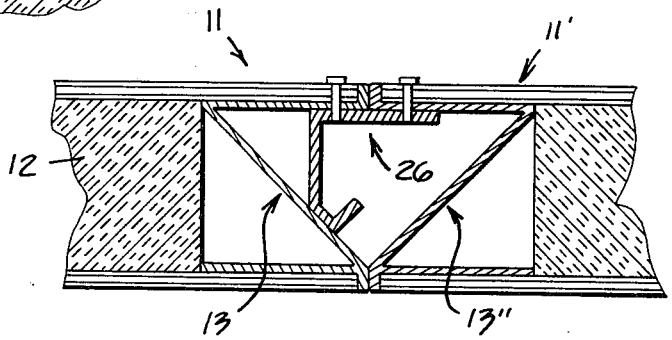
Figure 11:
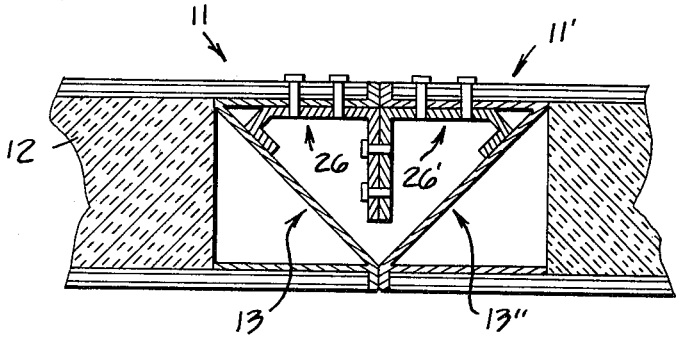

It may also be necessary to retain adjacent panels in abutting relationship. FIGS. 10 and 11 illustrate several methods of providing an abutting joint between panels 11 and 11′. FIG. 10 illustrates an abutting joint utilizing a single connector 26 wherein a portion of the first leg of connector 26 is affixed to frame member 13″ and the remainder of the first leg is affixed to frame 13 of panel 11. FIG. 11 illustrates the same type of joint utilizing two connectors 26, 26″ to provide the abutting joint.

It will be apparent that the joint created by wedging connector 26 into channel 25 of frame member 13 in a number of different configurations. However, in each configuration, connector 26 wedges tightly into groove 25 of frame member 13 to provide a tight joint resistant to the entry of weather and vermin. The tightness of the joint may be further enhanced by the application of a mastic material to groove 25 prior to mating of the channel member 26 thereinto. The mastic will thereupon be squeezed between the channel and frame member to enhance the seal.

Inner chamber 24, defined by core 12, frame leg 21, and web 23 may be utilized for running services such as electricity cables therethrough. Due to the design of frame member 13, such services will be protected by metal leg 21 and web 23 and will meet most code requirements for such protection.

In construction, adjacent panels are joined by guiding and tightly wedging the connector 26 of one panel into the mating frame member 13 of an adjacent panel. When placed into tight-wedging relationship, suitable fasteners are driven through the panel skin and frame member into the wedged connector (See FIGS. 8–11). Thus, a secure, tight joint is effected between adjacent panels.

What is claimed is:

1. In a panel structure including an insulational and structural core laminated between skin members, the improvement comprising frame members surrounding said core, said frame members having a generally Z-shaped cross-section including first and second, substantially planar, leg portions connected by a web portion, and wherein one leg portion and the web portion define a wedge shaped space opening to the interior of said panel and the other leg portion and the web portion define a second wedge shaped space opening to the exterior of said panel;

wherein one of said first and second leg portions is free of a protrusion;

wherein said skins are laminated to outer surfaces of said leg portions of the frame members; and wherein said Z-shaped frame members are sufficiently resilient such that the distance between the first and second leg portions can be varied to accommodate variations in the thickness of said core.

2. The panel of claim 1 wherein said frame members are metal extrusions.

3. The panel of claim 1 wherein a first flange is formed on the frame members at the end of one leg portion remote from said web portion and a second flange is formed on said frame portions adjacent the junction of said web portion and said second leg portion and wherein said flanges comprise upper and lower peripheral edges of said panel.

4. The panel of claim 3 wherein one each of said flanges abut one each of said skin members.

5. A connector structure in combination with first and second panels, the connector structure comprising a wedge shaped groove having first and second side meeting at a junction and defined by the edges of said first panel, an elongate connector affixed to said second panel having a wedge shaped cross-section and the elongate connector wedged into said groove of said first panel, and fastener means for retaining the connector in said groove;

wherein said elongate connector includes a first leg, a second leg joined to the first leg and bent upwardly and outwardly with respect to the first leg, and a third leg joined to the second leg and bent downwardly and outwardly with respect to the first leg; and wherein at least the first and third legs of said elongate connector can cooperate in a planar relationship with the sides of the wedge shaped groove such that the second leg is spaced from the junction of the groove to accommodate foreign bodies accidently lodged in said groove.

6. The joint structure of claim 5 wherein said connector means is co-extensive with the groove defined by one side of said first panel.

7. The joint structure of claim 5 wherein said connector means is affixed to a flat surface of said second panel.

8. The joint structure of claim 5 wherein said connector means is affixed to a wedge-shaped groove defined by the edges on one side of said second panel.

* * * * *